US006478398B2

(12) United States Patent
Dietl et al.

(10) Patent No.: US 6,478,398 B2
(45) Date of Patent: Nov. 12, 2002

(54) INK JET PRINTER HAVING A PRINTHEAD ASSEMBLY FOR RECORDING HIGH QUALITY GRAPHIC IMAGES AND PHOTO QUALITY IMAGES

(75) Inventors: Steven J. Dietl, Ontario, NY (US); Eduardo M. Freire, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/755,230

(22) Filed: Jan. 8, 2001

(65) Prior Publication Data

US 2002/0089577 A1 Jul. 11, 2002

(51) Int. Cl.[7] ..... B41J 2/205
(52) U.S. Cl. ..... 347/15; 347/87
(58) Field of Search ..... 347/9, 84, 85, 347/86, 87, 15, 43

(56) References Cited

U.S. PATENT DOCUMENTS 6,030,065 A * 2/2000 Fukuhata ..... 347/15
6,145,961 A * 11/2000 Otsuki ..... 347/43

* cited by examiner

*Primary Examiner*—Anh T. N. Vo
(74) *Attorney, Agent, or Firm*—Tallam I. Nguti

(57) ABSTRACT

When a thermoplastic spacer is applied to a glass pane in the production of insulating glass panes, the nozzle from which the plastic with the desired cross sectional shape is extruded along the edge of the glass pane. The speed with which the plastic is applied along the edge of the glass pane is chosen depending on the temperature of the plastic. Here, for a stipulated temperature setpoint the speed with which the plastic is applied along the edge of the glass pane is stipulated. If the temperature increases, the speed is increased; conversely, when the temperature drops below the setpoint, the speed with which the plastic is applied along the edge of the glass pane is reduced. This ensures that the correct amount of thermoplastic is always extruded onto the glass pane and a spacer with a uniform cross section is obtained.

9 Claims, 2 Drawing Sheets

INK JET PRINTER HAVING A PRINTHEAD ASSEMBLY FOR RECORDING HIGH QUALITY GRAPHIC IMAGES AND PHOTO QUALITY IMAGES

BACKGROUND OF THE INVENTION

1. Field of the Invention

The invention relates to a process for applying a spacer of thermoplastic to a glass pane in the course of producing insulated glass panes ii which thermoplastic is applied to a glass pane along its edge.

2. Description of Related Art

In addition to spacers of metal, generally hollow aluminum sections, producing insulating glass with plastic spacers has been known for a long time, there being essentially two embodiments.

One embodiment ("swiggle strip") uses a prefabricated strand of butyl rubber which, withdrawn from a storage reel, is pressed onto one glass pane of an insulating glass pane (DE 37 26 274 C).

Another process ("Biver" process) calls for applying a setting plastic to the glass pane from a nozzle which is moved along the edge of the glass pane (EP 0 176 388 A).

Finally, recently it has been repeatedly proposed that thermoplastic spacers be used, generally proceeding such that the thermoplastic is extruded directly onto one glass pane from an application nozzle as a strand with the desired cross sectional shape—generally rectangular (DE 196 32 063 C). In the latter process for producing spacers for insulating glass panes, when the strand which is designed to be used as the spacer is applied, due to the use of thermoplastic, problems arise to the extent that the accurate control of the amount of thermoplastic to be applied is not easily possible. In one known process the attempt is made to use the amount to be applied for accurate proportioning by combination of a plunger pump for delivery of thermoplastic to the nozzle and a gear pump which is provided on the nozzle.

The latter measure (combination plunger pump-gear pump) is not able to ensure under all circumstances that exactly the correct amount of thermoplastic is applied to the glass pane per unit of length of spacer which is to be applied from the nozzle.

The reason for this is that the viscosity, therefore the flow behavior of the thermoplastic, is extremely dependent on temperature. Regardless of the circumstance that insulated lines are used for transport of the thermoplastic heated to a temperature which corresponds to the desired flow behavior to the nozzle, major problems occur when the temperature fluctuates.

Control of the delivery pressure depending on quantity and viscosity in the processing of thermoplastic is known from AT 399 497 B, EP 0 124 188 A and US 4 922 852 A.

SUMMARY OF THE INVENTION

The object of the invention is to devise a process of the initially mentioned type with which it is ensured as independently of temperature fluctuations as possible that the correct amount of thermoplastic is applied at the time to form a spacer for insulating glass panes.

DESCRIPTION OF THE PREFERRED EMBODIMENTS

This object is achieved as claimed in the invention in that the temperature of the thermoplastic is acquired at least in the area of the location at which the plastic is applied to the glass pane, that the speed with which the plastic is applied along the edge of the glass pane is increased when the temperature of the thermoplastic acquired in the area of the location at which the plastic is applied to the glass pane is increased above a given setpoint, and that the speed with which the plastic is applied along the edge of the glass pane is reduced when the temperature which is acquired in the area of the location at which the plastic is applied to the glass pane drops below a given setpoint.

Because of the fact that in the invention the temperature of the thermoplastic is measured as it emerges from the nozzle, therefore at the location at which the plastic is applied to the glass pane and the relative speed between the nozzle and the glass pane is changed as a function of the ascertained temperature and thus depending on the flow behavior of the thermoplastic as it emerges from the nozzle, it is ensured that even when the temperature changes the correct amount of thermoplastic is applied to the glass pane per unit of length as the spacer so that a cross sectional shape of the thermoplastic spacer which is uniform over the entire length of the spacer is ensured.

The invention takes into account the circumstance that when the pressure generated by the conveyor means (plunger pump, gear pump or combination of pumps) remains the same, the amount of thermoplastic emerging from the nozzle per unit of time depends on its temperature. Thus temperature changes of only a few degrees have a noticeable effect on the amount of thermoplastic which emerges from the nozzle per unit of time.

In one embodiment of the process as claimed in the invention it proceeds such that the pressure with which the thermoplastic is delivered to the location at which the plastic is applied to the glass pane is kept constant at least in one area of stipulated deviations of the temperature from the stipulated temperature.

In practical execution of the process as claimed in the invention it is possible to change the delivery pressure with which the thermoplastic emerges from the nozzle for greater changes in the temperature of the thermoplastic. Here, within the framework of the invention the process takes place such that the conveyor pressure is increased when the temperature of the thermoplastic drops below a stipulated boundary value in the area of the location at which the plastic is applied to the glass pane, or that the delivery pressure is reduced when the temperature of the thermoplastic in the area of the location at which the plastic is applied to the glass pane, rises above a stipulated boundary value.

By means of the latter two measures, the extent of the temperature-dependent changes of the speed with which the plastic is applied along the edge of the glass pane is kept small.

The control of speed as claimed in the invention with which the plastic is applied to the glass pane is especially accurate when as claimed in the invention the temperature of the thermoplastic is measured directly at the location at which the plastic is applied to the glass pane.

Even if it is enough in practice when the temperature of the thermoplastic is measured directly at the nozzle, it is advantageous in practice when according to one proposal of the invention the temperature of the thermoplastic is acquired at least at one other location at a distance from the location at which the plastic is applied to the glass pane, especially in the area of the flow path of the plastic to the nozzle. The measure of the temperature of the thermoplastic at least at one location of the delivery line at a distance from the nozzle makes it possible to prepare the control of the relative speed between the nozzle, therefore the location at which the plastic is applied to the glass pane, and the glass pane for an incipient change of the temperature of the thermoplastic so to speak so that the actual change of the relative speed between the nozzle and the glass pane can be executed promptly and in the correct direction (increase or decrease of the relative speed).

When the temperature of the thermoplastic is measured not only directly at the nozzle mouth, but also at a distance from the nozzle mouth at least at one location of the delivery line which supplies the thermoplastic to the nozzle, there is for example also the possibility of controlling the relative speed between the nozzle and the glass pane, therefore the speed with which the nozzle moves along the edge of the glass pane to which a thermoplastic spacer is to be applied, depending on the average of these at least two ascertained temperatures.

To execute the process as claimed in the invention it is irrelevant whether the nozzle from which the plastic is applied to the glass pane moves along the edge of a stationary glass pane or whether the glass pane is moved along a stationary nozzle. Combinations of these two possibilities of effecting relative motion between the nozzle and glass pane are also conceivable. Thus for example it can be imagined that for part of the edges of the glass pane (generally the edges which are horizontal when the glass pane is standing perpendicularly) the glass pane is moved along the stationary nozzle, and that the nozzle is moved along the perpendicular edges.

By means of the measures proposed as claimed in the invention which can if necessary be developed by the possible embodiments of the invention which are named in the dependent claims is it ensured that the amount of thermoplastic applied per unit of length of thermoplastic spacer to be produced is kept constant even when the temperature fluctuates.

Here it is advantageous that changes of the delivery pressure in the normal case are not necessary so that the delivery pressure can be kept constant; this is more easily possible than keeping the temperature constant since this depends on many parameters, which include for example the ambient temperature and the temperature of the glass pane.

The process as claimed in the invention can be further equipped as follows.

Not only the temperature, but also the backpressure at the nozzle is measured and the result of pressure measurement is incorporated into the path control of the nozzle (control of the relative speed between the nozzle and glass pane). The reason for this measure is that the thermoplastic mass which forms the spacer frame can have different consistency even if it is taken from a single skein. This can be the case for example when mixing is not entirely homogenous and in the skein there are for example proportions of the thermoplastic mass with a higher proportion of filler.

In particular when the backpressure increases (which is caused by more of the thermoplastic mass being delivered to the nozzle than can emerge from the nozzle) the path control is changed for the purposes of increasing the relative speed between the nozzle and glass pane. At the same time the temperature control, therefore the heating of the thermoplastic can be adapted and in this case the heating output is increased in order to heat the plastic to a higher temperature. Feasibly when the backpressure on the nozzle drops (this occurs when the thermoplastic emerges "too easily" from the nozzle), the path control is changed for purposes of reducing the relative speed between the nozzle and the glass pane is changed. In this case the temperature of the thermoplastic can also be reduced by choking the heating.

In summary, one preferred embodiment of the process as claimed in the invention can be described as follows.

When a thermoplastic spacer is applied to a glass pane in the production of insulating glass panes, the nozzle from which the thermoplastic with the desired cross sectional shape is extruded onto a glass pane is moved along the edge of the glass pane. The speed with which the nozzle is moved along the edge of the glass pane is chosen depending on the temperature of the plastic. Here, for a stipulated temperature setpoint the speed with which the nozzle moves along the edge of the glass pane is stipulated. If the temperature changes up, the speed is increased, conversely when the temperature drops below the setpoint, the speed with which the nozzle is moved along the edge of the glass pane is reduced. This ensures that the correct amount of thermoplastic is always extruded onto the glass pane and a spacer with a uniform cross section is obtained.

What is claimed is:

1. Process for applying a spacer of thermoplastic to a glass pane in the course of producing insulated glass panes comprising the steps of:

applying thermoplastic through an applicator to a glass pane along an edge of the glass pane by moving the applicator relative to the glass pane;

measuring a temperature of the thermoplastic as the thermoplastic emerges from the applicator;

increasing a speed of the movement of the applicator relative to the glass pane if the measured temperature of the thermoplastic exceeds a predetermined setpoint; and decreasing the speed of the movement of the applicator relative to the glass pane if the measured temperature of the thermoplastic drops below the predetermined setpoint.

2. Process as claimed in claim 1, wherein a pressure with which the thermoplastic is delivered to the glass pane is kept constant within a predetermined range of the measured temperature encompassing the predetermined setpoint.

3. Process as claimed in claim 2, comprising the further step of increasing the pressure with which the thermoplastic is delivered to the glass pane if the measured temperature of the thermoplastic drops below the predetermined range.

4. Process as claimed in claim 2, comprising the further step of decreasing the pressure with which the thermoplastic is delivered to the glass pane if the measured temperature of the thermoplastic rises above the predetermined range.

5. Process as claimed in claim 1, wherein the temperature of the thermoplastic is measured directly at the location at which the thermoplastic is applied to the glass pane.

6. Process as claimed in claim 1, further comprising the step of measuring a second temperature of the thermoplastic at at least one location in a supply path for the thermoplastic prior to the applicator.

7. Process as claimed in claim 2, wherein the temperature of the thermoplastic is measured directly at the location at which the thermoplastic is applied to the glass pane.

8. Process as claimed in claim 3, wherein the temperature of the thermoplastic is measured directly at the location at which the thermoplastic is applied to the glass pane.

9. Process as claimed in claim 4, wherein the temperature of the thermoplastic is measured directly at the location at which the thermoplastic is applied to the glass pane.

US 6,478,398 B2
5 6
* * * * *

UNITED STATES PATENT AND TRADEMARK OFFICE

CERTIFICATE OF CORRECTION

PATENT NO. : 6,478,398 B2
DATED : November 12, 2002
INVENTOR(S) : Steven J. Dietl et al.

It is certified that error appears in the above-identified patent and that said Letters Patent is hereby corrected as shown below:

See Abstract.
See Specification.
See Claims.

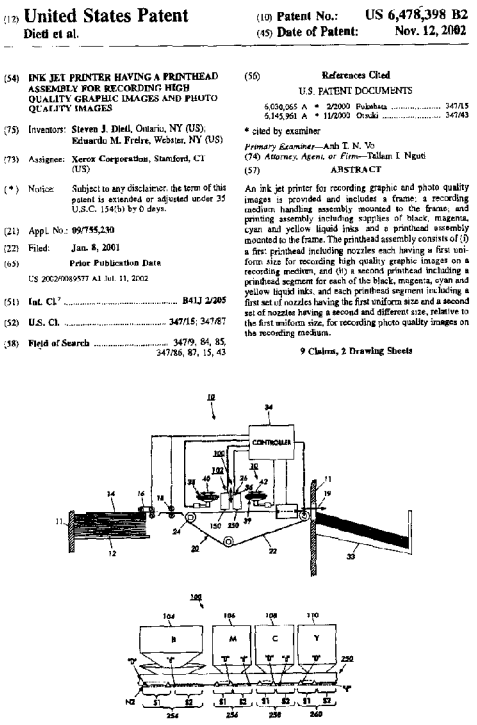

(12) United States Patent
Dietl et al.

(10) Patent No.: US 6,478,398 B2
(45) Date of Patent: Nov. 12, 2002

(54) INK JET PRINTER HAVING A PRINTHEAD ASSEMBLY FOR RECORDING HIGH QUALITY GRAPHIC IMAGES AND PHOTO QUALITY IMAGES

(75) Inventors: Steven J. Dietl, Ontario, NY (US); Eduardo M. Freire, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/755,230

(22) Filed: Jan. 8, 2001

(65) Prior Publication Data

US 2002/0089577 A1 Jul. 11, 2002

(51) Int. Cl.[7] ..... B41J 2/205

(52) U.S. Cl. ..... 347/15; 347/87

(58) Field of Search ..... 347/9, 84, 85, 347/86, 87, 15, 43

(56) References Cited

U.S. PATENT DOCUMENTS 6,050,065 A * 2/2000 Fukuhara ..... 347/15
6,145,961 A * 11/2000 Otsuki ..... 347/43

* cited by examiner

*Primary Examiner*—Anh T. N. Vo
(74) *Attorney, Agent, or Firm*—Tallam I. Nguti

(57) ABSTRACT

An ink jet printer for recording graphic and photo quality images is provided and includes a frame; a recording medium handling assembly mounted to the frame; and printing assembly including supplies of black, magenta, cyan and yellow liquid inks and a printhead assembly mounted to the frame. The printhead assembly consists of (i) a first printhead including nozzles each having a first uniform size for recording high quality graphic images on a recording medium, and (ii) a second printhead including a printhead segment for each of the black, magenta, cyan and yellow liquid inks, and each printhead segment including a first set of nozzles having the first uniform size and a second set of nozzles having a second and different size, relative to the first uniform size, for recording photo quality images on the recording medium.

9 Claims, 2 Drawing Sheets

Signed and Sealed this

Fourteenth Day of October, 2003

JAMES E. ROGAN
*Director of the United States Patent and Trademark Office*

(12) United States Patent
Dietl et al.

(10) Patent No.: US 6,478,398 B2
(45) Date of Patent: Nov. 12, 2002

(54) INK JET PRINTER HAVING A PRINTHEAD ASSEMBLY FOR RECORDING HIGH QUALITY GRAPHIC IMAGES AND PHOTO QUALITY IMAGES

(75) Inventors: Steven J. Dietl, Ontario, NY (US); Eduardo M. Freire, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/755,230

(22) Filed: Jan. 8, 2001

(65) Prior Publication Data

US 2002/0089577 A1 Jul. 11, 2002

(51) Int. Cl.[7] ..... B41J 2/205

(52) U.S. Cl. ..... 347/15; 347/87

(58) Field of Search ..... 347/9, 84, 85, 347/86, 87, 15, 43

(56) References Cited

U.S. PATENT DOCUMENTS 6,030,065 A * 2/2000 Fukuhata ..... 347/15
6,145,961 A * 11/2000 Otsuki ..... 347/43

* cited by examiner

*Primary Examiner*—Anh T. N. Vo
(74) *Attorney, Agent, or Firm*—Tallam I. Nguti

(57) ABSTRACT

An ink jet printer for recording graphic and photo quality images is provided and includes a frame; a recording medium handling assembly mounted to the frame; and printing assembly including supplies of black, magenta, cyan and yellow liquid inks, and a printhead assembly mounted to the frame. The printhead assembly consists of (i) a first printhead including nozzles each having a first uniform size for recording high quality graphic images on a recording medium, and (ii) a second printhead including a printhead segment for each of the black, magenta, cyan and yellow liquid inks, and each printhead segment including a first set of nozzles having the first uniform size and a second set of nozzles having a second and different size, relative to the first uniform size, for recording photo quality images on the recording medium.

9 Claims, 2 Drawing Sheets

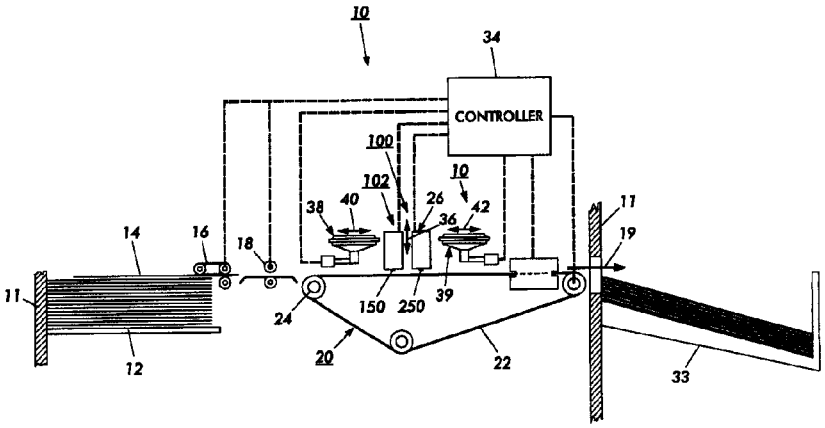

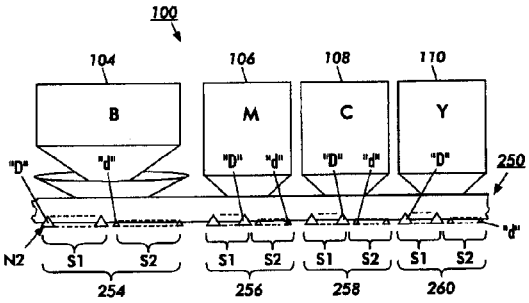

INK JET PRINTER HAVING A PRINTHEAD ASSEMBLY FOR RECORDING HIGH QUALITY GRAPHIC IMAGES AND PHOTO QUALITY IMAGES

BACKGROUND OF THE INVENTION

The present invention relates generally to printers such as ink jet printers, and more particularly to such a printer having a printhead assembly or cartridge that is suitable for recording or printing high quality graphic images, and photo quality images.

An ink jet printer of the type frequently referred to as drop-on-demand, has at least one printhead from which droplets of ink are directed towards a recording medium. Within the printhead, the ink is contained in a plurality of channels. Piezoelectric devices or power pulses cause the droplets of ink to be expelled as required, from orifices or nozzles located at the end of the channels. In thermal ink jet printing, the power pulses are usually produced by resistors also known as heaters, each located in a respective one of the channels. The heaters are individually addressable to heat and vaporize the ink in the channels. As a voltage is applied across a selected heater, a vapor bubble grows in that particular channel and ink bulges from the channel nozzle. At that stage, the bubble begins to collapse. The ink within the channel retracts and then separates from the bulging ink thereby forming a droplet moving in a direction away from the channel nozzle and towards the recording medium whereupon hitting the recording medium a spot is formed. The channel is then refilled by capillary action which, in turn, draws ink from a supply container of liquid ink.

The ink jet printhead may be incorporated into either a carriage type printer or a page width type printer. The carriage type printer typically has a relatively small printhead containing the ink channels and nozzles. The printhead is usually sealingly attached to a disposable ink supply cartridge and the combined printhead and cartridge assembly is attached to a carriage which is reciprocated to print one swath of information (equal to the length of a column of nozzles) at a time on a stationary recording medium, such as a sheet of paper or a transparency.

After each such swath is printed, the sheet of paper is transported or advanced forwardly (usually the movement involves stepping or indexing) a distance that is equal to the height of the printed swath or of a portion thereof so that the next printed swath is properly registered in an overlapping or contiguous manner therewith. The procedure is then repeated until an entire page on the sheet is printed.

It has been recognized that there is a need for such an ink jet printer having a printhead assembly that is suitable for recording or printing high quality graphic images, and photo quality images.

SUMMARY OF THE INVENTION

In accordance with the present invention, there is provided an ink jet printer for recording graphic and photo quality images. The ink jet printer includes a frame; a recording medium handling assembly mounted to the frame; and printing assembly including supplies of black, magenta, cyan and yellow liquid inks, and a printhead assembly mounted to the frame. The printhead assembly consists of (i) a first printhead including nozzles each having a first uniform size for recording high quality graphic images on a recording medium, and (ii) a second printhead including a printhead segment for each of the black, magenta, cyan and yellow liquid inks, and each printhead segment including a first set of nozzles having the first uniform size and a second set of nozzles having a second and different size, relative to the first uniform size, for recording photo quality images on the recording medium.

BRIEF DESCRIPTION OF THE DRAWINGS

In the detailed description of the invention presented below, reference is made to the drawings, in which.

DETAILED DESCRIPTION OF THE INVENTION

Figure 1:
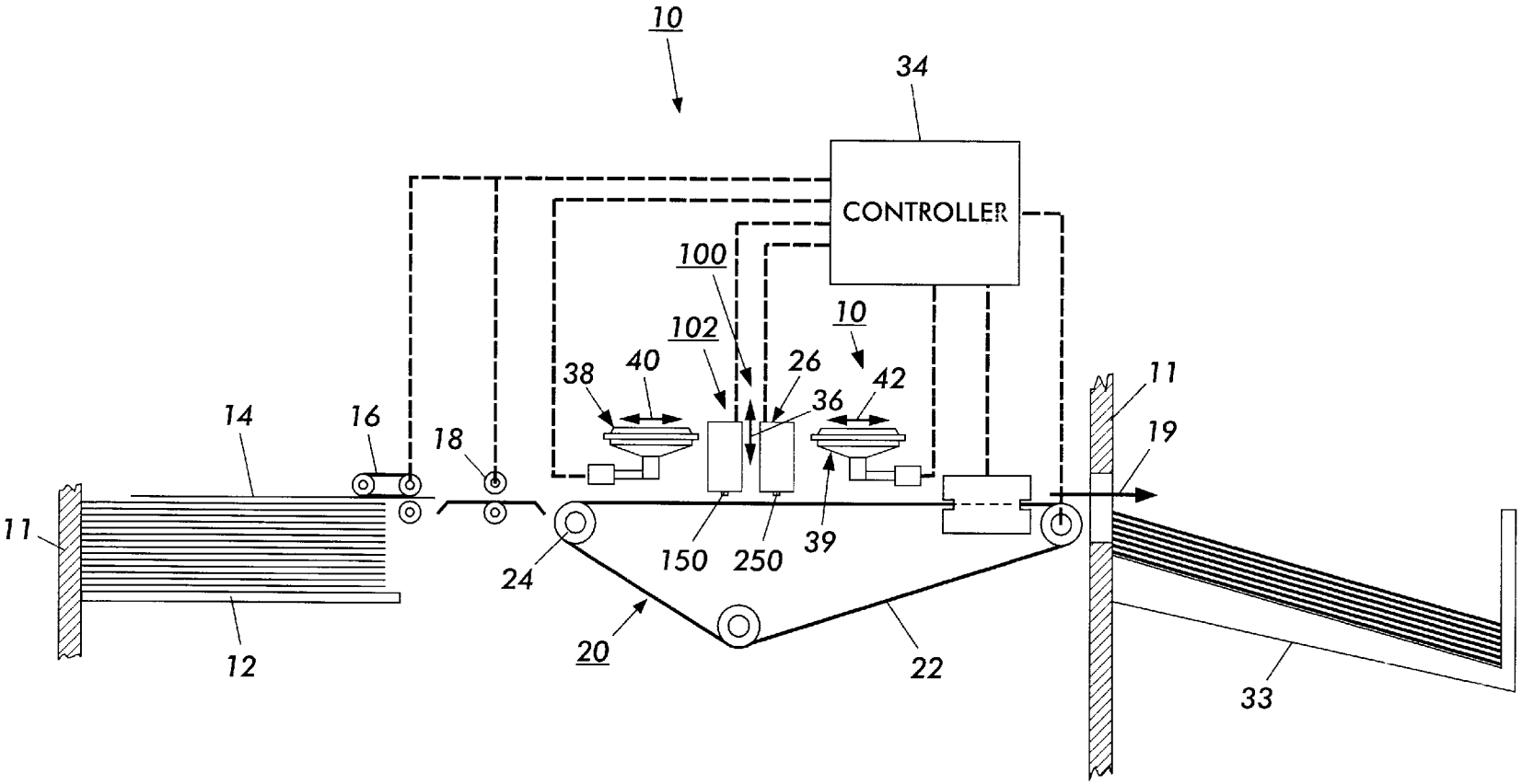
FIG. 1 is a schematic illustration of a liquid ink printer including the printhead assembly or cartridge, in accordance with the present invention, for printing high quality graphic images and photo quality images.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Although the present invention discussed herein may be used for drying any image which is created by a liquid ink printer, the description of the present invention will be described in the environment of an ink jet printer such as that shown in the drawings.

FIG. 1 illustrates a schematic elevational view of a liquid ink printer 10, for instance, an ink jet printer, of the present invention. The liquid ink printer 10 includes a frame 11, and an input tray 12 containing sheets of a recording medium 14 to be printed upon by the printer 10. Single sheets of the recording medium 14 are removed from the input tray 12 by a pickup device 16 and fed by feed rollers 18 to a transport mechanism 20. For printing ink images on a sheet or recording medium 14, the transport mechanism 20 moves the sheet by a feed belt or belts 22 driven by rollers 24 beneath a printing assembly 100 that includes a liquid ink printhead assembly 102. In accordance with the present invention (to be described in detail below), the liquid printhead assembly or cartridge 102 includes at least one printhead 250, or a pair of printheads 150, 250 as shown. After such printing, the recording medium 14 is then carried by the belt 22 through a dryer assembly 32, into an output tray 33.

A controller 34 controls the operation of components of the printer 10, including the printheads 150, 250 and the transport mechanism 20, which includes the pickup device 16, the feed roller 18 and the drive roller 24. In addition, the controller 34 controls the movement of the printhead assembly 102, and particularly printing by the printhead 250 or 150, 250 in accordance with the present invention. The controller 34 can also include a plurality of individual controllers, such as microprocessors or other known devices dedicated to perform a particular function.

At the completion of a printing operation or when otherwise necessary, such as during a power failure, the printhead assembly 102, which is movable in the directions of an arrow 36, is moved away from the belt 22 such that a capping assembly 38, 39 which is movable in the directions of the arrow 40, 42, is moved beneath the printhead assembly 102 for capping the printheads 150, 250. Once the capping assembly 38, 39 is positioned directly beneath the printhead assembly 102, the printhead assembly 102 with the printheads 150, 250, are moved towards the belt 22 and into contact with a plurality of capping gaskets (not shown) located on the capping assembly 38, 39.

Figure 2:
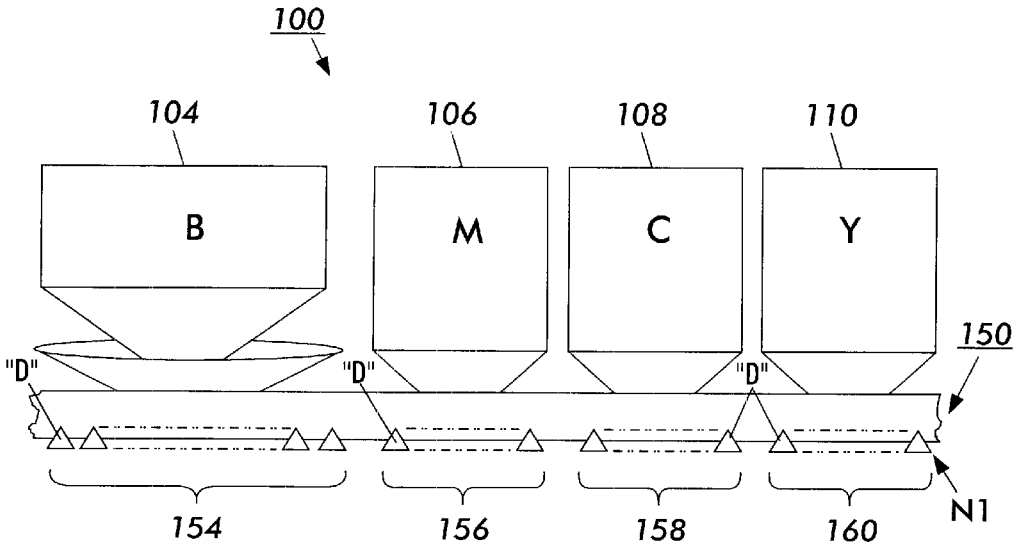
FIG. 2 is a schematic illustration of the first printhead of the printhead assembly, in accordance with the present invention, for printing high quality graphic images.
Figure 3:
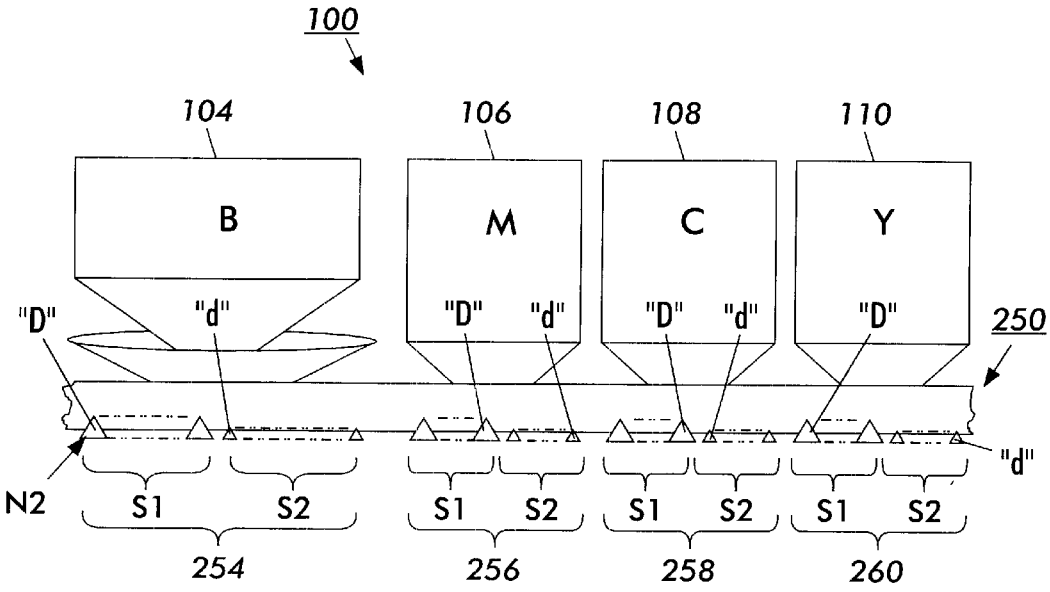
FIG. 3 is a schematic illustration of the second printhead of the printhead assembly, in accordance with the present invention, for printing photo quality images.
Figure 1:
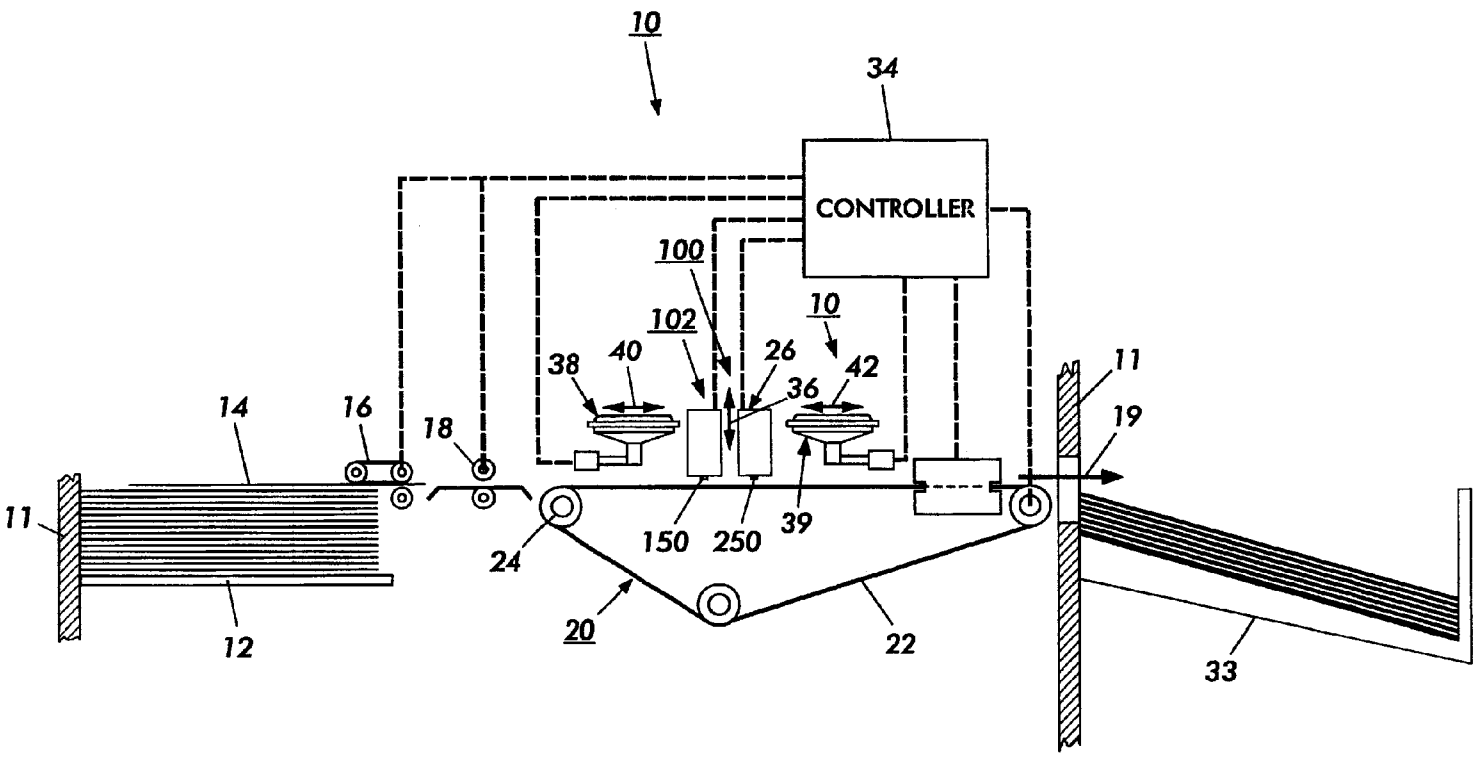
Figure 2:
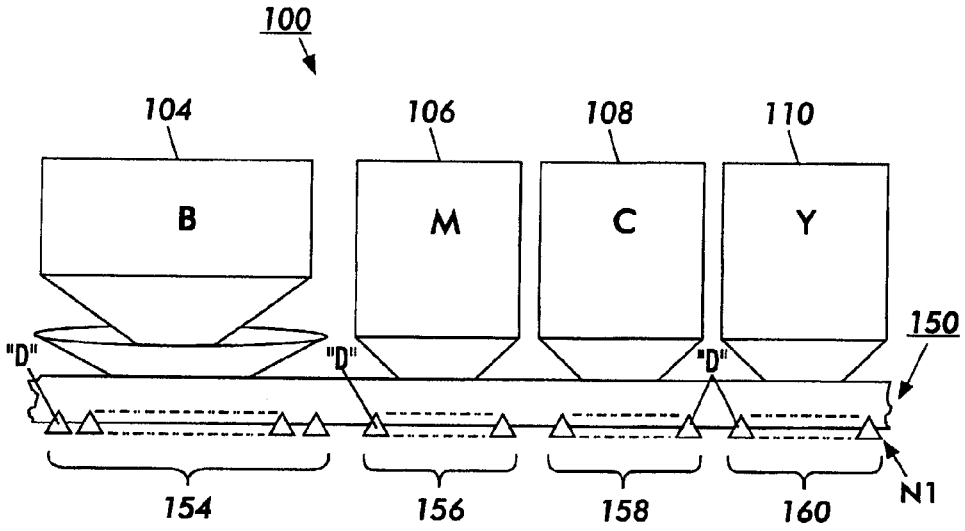
Figure 3:
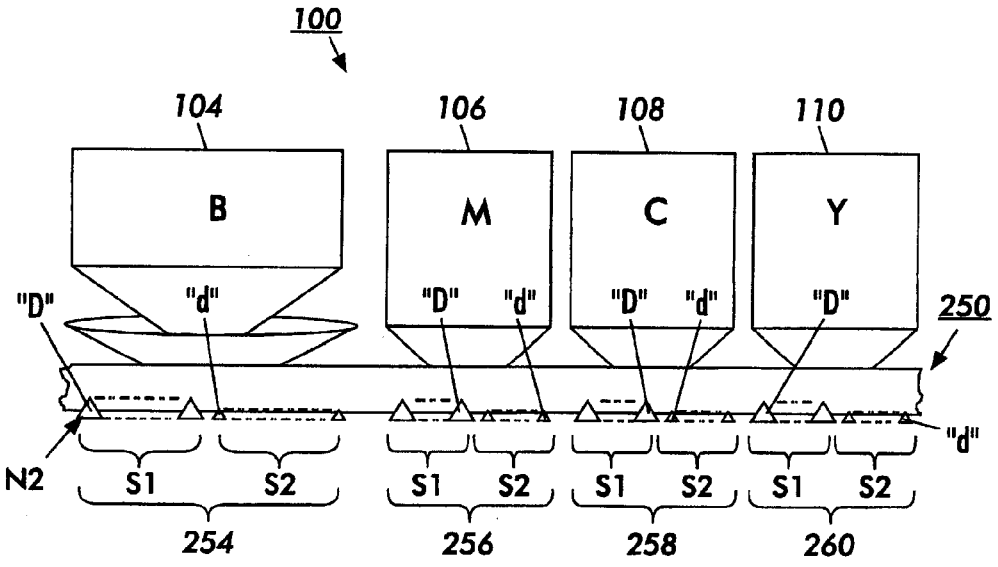

Referring now to FIGS. 1–3, preferably, the printhead assembly 102 includes one or more printheads 150, 250 that are each supported in a printing position on the printer frame 11. and in a confronting relation with the belt 22. In accordance with the present invention, in what is referred to as a single-printhead printer, in which the printhead assembly 102 includes only one printhead, the one printhead will have the structure, functions and advantages of the second printhead 250, as is to be described below.

In either case, during printing, the printhead 250 or printheads 150, 250 deposit liquid ink on the recording medium 14 as it is carried by the belt 22 beneath and passed such printheads 150, 250. Each of the printheads 150, 250 includes an array of print nozzles N1, N2 respectively, in accordance with the present invention (to be described in detail below), having a length sufficient to deposit ink in a print zone on the recording medium 14. The present invention is equally applicable to printers having pagewidth array printheads, however, it will be described for example with respect to printers having partial width array, such as one inch array, ink jet printheads. Accordingly, the number of nozzles per array, for example will be 300 nozzles, with a 300 nozzles per inch resolution. As further illustrated (FIGS. 2–3), the printhead assembly 102 is part of a printing assembly 100 that includes ink supplies 104, 106, 108, 110 connected to the printheads 150, 250 through appropriate ink supply conduits.

Referring now to FIGS. 1–3, the printing assembly 100 and/or the printhead assembly 102 may be provided in the form of a cartridge that is replaceable by the user. The ink supplies 104, 106, 108, 110 may be part of the printhead cartridge or they may be replaceable separately from the printheads as part of ink supplies means. As such, and in the case of a single-printhead printer, the present invention could then be directed to a printing cartridge 102 that includes the ink supply means 104, 106, 108, 110, and a printhead 250 for recording quality graphic images and photo quality images on the recording medium 14. As will be described below, the printhead 250 includes a printhead segment for each color ink of black, magenta, cyan and yellow liquid inks, and each such printhead segment includes a first set of nozzles having a first uniform size "D", and a second set of nozzles having a second and different size "d", relative to the first uniform size.

Referring now to FIGS. 2–3, the printhead assembly or cartridge 102 is mounted to the frame 11, and alternatively includes or consists of (i) the first printhead 150 including an array of nozzles N1 each having a first uniform size "D" for recording high quality graphic images on the recording medium 14. In accordance with the present invention, the first printhead 150, when a multicolor printhead, includes printhead segments 154, 156, 158, 160 for each of the different color liquid inks of black, magenta, cyan and yellow.

The printhead assembly 102 also includes or consists of the second printhead 250 including an array of nozzles N2 for recording photo quality images on the recording medium 14. In accordance with the present invention, the second printhead 250 includes printhead segments 254, 256, 258, 260 for each of the different color liquid inks of black, magenta, cyan and yellow.

Each of the printhead segments 254, 256, 258, 260 of the second printhead 250 includes a first set S1 of nozzles having the first uniform size "D", and a second set S2 of nozzles having a second and different size "d", preferably smaller, relative to the first uniform size "D". The number of nozzles in the first set S1 and those in the second set S2 may be equal, or the number of nozzles in the second set S2 can be within a range of one-third to one-half those in the first set S1.

As also shown, the second printhead 250 preferably is also a multicolor printhead including printhead segments 254, 256, 258, 260 for each color ink of black, magenta, cyan and yellow, and each of the printhead segments 254, 256, 258, 260 that are each connected to a corresponding color ink supply of the ink supplies 104, 106, 108, 110. In accordance with the present invention, on the second printhead 250, the printhead segment 254 for black liquid ink includes a first set S1 (of "D" size) and a second set S2 (of "d" size) nozzles that together preferably comprises 40% of a total number of nozzles on the second printhead 250. For example, where the total number of nozzles on the second printhead 250 is equal to 300, the first set S1 nozzles, and the second set S2 nozzles (or 40%) of the total number of nozzles on the second printhead 250, is accordingly 120 nozzles. Relative to the first set S1 (of "D" size nozzles), the second set S2 (of "d" size nozzles) includes a number of nozzles that is equal to ⅓ to ½ the number "D" size nozzles of the first set S1.

Further, in accordance with this aspect of the present invention, the other remaining printhead segments 254, 256, 258, 260 (on the second printhead 250) for magenta, cyan and yellow liquid inks, respectively, also each include a first set S1, (of "D" size) nozzles and a second set S2 of ("d" size) nozzles which together comprise 20% of the total number of nozzles on the second printhead 250.

For example, where the total number of nozzles on the second printhead 250 is equal to 300, the first set (S1) nozzles, and the second set (S2) nozzles (or 20% of the total number of nozzles), is accordingly 60 nozzles. Relative to the first set S1 (of "D" size) nozzles, the second set S2 (of "d" size nozzles) of each of the other remaining printhead segments 256, 258, 260, respectively, includes the number of nozzles that is equal to ⅓ to ½ the number of "D" size nozzles. In either case, each of the printhead segments 254, 256, 258, 260 of the second printhead 250 is connected to the corresponding color ink supply of the ink supplies 104, 106, 108, 110. Preferably, the first set S1 of "D" size nozzles and the second set S2 of "d" size nozzles, of each the printhead segments of the second printhead 250, have an equal number of nozzles, meaning is equal to for each segment.

Specifically, and for example, the first printhead 150 is designed with 120 of its jets or nozzles N1 for black ink, and 60 nozzles each for cyan, magenta and yellow inks, and all nozzles N1 thereof having the one uniform size "D". The second printhead 250, which is preferably replaceable, is designed with each of the segments 254, 256, 258, 260 for black, magenta, cyan and yellow inks respectively, consisting of two different sets (the first set and the second set S1, S2) of the nozzles N2. The first set S1 of nozzles for each of the segments 254, 256, 258, 260 includes nozzles each having the first uniform size "D", and the second set S2 thereof includes nozzles having the second and different, preferably smaller, size "d". The second printhead 250 as such provides excellent, low granularity, and thus photo print quality images even though it basically employs or is based on the same printhead design as the first printhead 150. In fact, the ink tanks or supplies 104, 106, 108, 110 and the fluidic or liquid ink passageways connecting them to the different and appropriate printhead segments 254, 256, 258, 260 are preferably common across both the first and the second printheads 150, 250.

As is illustrated, on the second printhead 250, about one third to one half, preferably one half, of the jets or nozzles N2 of each of the color segments 254, 256, 258, 260 have the second and smaller size "d" so as to produce a spot that is half the size of a spot produced by a nozzle having the size "D". Advantageously, this enables and allows production of multiple gray levels in the photo mode. For example, if the nozzles having a size "D" each produce a spot size of 60 μm, then the smaller jets or nozzles having the size "d" will each produce a spot size of 20–30 μm. In producing a photo image the printer driver can process the image to be printed so as to place, for any given address, either 1 small drop (equal to a spot), 2 small drops using a nozzles of size "d", or a single large drop using a nozzle of size "D". This will allow for very low granularity prints to be made but at the same time also allow a reasonable throughput rate by using only the large jets or nozzles of size "D" in a normal mode text only printing operation, for example.

The drop ejectors or nozzles may each have a rectangular cross section, in which case "D", "d" can be the diagonal measurements, or they may each have a circular cross-section with "D" and "d" being diameter measurements. In either case, the nozzles preferably are made by patterning a thick polyimide layer as is well known in the art. In order to successfully form small size and large size nozzles from the same polyimide layer, a different method needs to be used for each different size of nozzles. It is recommended to use heaters across the whole array, but to use a heater pit extension for the small size jets or nozzles of size "d", so as to increase the latency in such nozzles. To do so, it is important to note that making equal size polysilicon heaters and then attempting to cover the ends with thin polyimide is not recommended since it results in high jitter when multiple prepulsing schemes are used. Instead, it is recommended to use different implant doses for the black and color sections. Alternatively a less energy efficient path would be to use black size heaters for the color jets or nozzles but with longer heater setbacks.

For the single-printhead printer alternative including only the printhead 250 having the two different size sets S1, S2, is recommended that the threshold voltage be the same across the whole array of large size and small size nozzles. As pointed out above, the ink tanks or supplies 104, 106, 108, 110, as well as the port manifold, fine manifold, and fluid seals preferably are made common parts across both print heads.

As can be seen, there has been provided an ink jet printer for recording graphic and photo quality images. The ink jet printer includes a frame; a recording medium handling assembly mounted to the frame; and printing assembly including supplies of black, magenta, cyan and yellow liquid inks, and a printhead assembly mounted to the frame. The printhead assembly consists of (i) a first printhead including nozzles each having a first uniform size for recording high quality graphic images on a recording medium, and (ii) a second printhead including a printhead segment for each of the black, magenta, cyan and yellow liquid inks, and each printhead segment including a first set of nozzles having the first uniform size and a second set of nozzles having a second and different size, relative to the first uniform size, for recording photo quality images on the recording medium.

What is claimed is:

1. An ink jet printer for recording high quality graphic and photo quality images, the ink jet printer comprising:

(a) a frame;

(b) a recording medium handling assembly mounted to said frame; and (c) a printing assembly including ink supplies of black, magenta, cyan and yellow liquid inks, and a printhead assembly, mounted to said frame, said printhead assembly consisting of (i) a first printhead including nozzles each having a first uniform size for recording high quality graphic images on a recording medium, and (ii) a second printhead for recording photo quality images on the recording medium, said second printhead including a printhead segment for each color ink of black, magenta, cyan and yellow liquid inks, and each said printhead segment including a first set of nozzles having said first uniform size, and a second set of nozzles having a second and different size, relative to said first uniform size.

2. The ink jet printer of claim 1, wherein said first printhead is a multicolor printhead including a printhead segment for each color ink of black, magenta, cyan and yellow liquid inks, and each said printhead segment for each color ink of black, magenta, cyan and yellow liquid inks is connected to a corresponding color ink supply of said ink supplies.

3. The ink jet printer of claim 1, wherein each printhead segment of said second printhead, for each color ink of black, magenta, cyan and yellow liquid inks, is connected to a corresponding color ink supply of said ink supplies.

4. The ink jet printer of claim 3, wherein a printhead segment for black liquid ink includes a first number of nozzles comprising 40% of a total number of nozzles on said first printhead.

5. The ink jet printer of claim 4, wherein said first printhead includes a total number of nozzles equal to 300, and said 40% of said total number of nozzles is 120 nozzles.

6. The ink jet printer of claim 4, wherein printhead segments for magenta, cyan and yellow liquid inks, respectively each include a second number of nozzles comprising 20% of the total number of nozzles on said first printhead.

7. The ink jet printer of claim 1, wherein said first set of nozzles and said second set of nozzles, of each said printhead, have a third and equal number of nozzles.

8. The ink jet printer of claim 1, wherein said at least second and different size of each nozzle of said at least second set of nozzles is equal to ⅓ to ½ of said first uniform size.

9. The ink jet printer of claim 6, wherein said second number of nozzles comprises 60 nozzles.

* * * * *

UNITED STATES PATENT AND TRADEMARK OFFICE

CERTIFICATE OF CORRECTION

PATENT NO. : 6,478,398 B2
DATED : November 12, 2002
INVENTOR(S) : Dietl et al.

It is certified that error appears in the above-identified patent and that said Letters Patent is hereby corrected as shown below:

Title page,
Item [73], Assignee, please delete "Illinois Tool Work Inc." and insert
-- Illinois Tool Works Inc. --.
Item [57], ABSTRACT,
Line 2, please delete "slottedd" and insert -- slotted --.

Signed and Sealed this

Third Day of May, 2005

JON W. DUDAS
*Director of the United States Patent and Trademark Office*